US009597709B2

(12) United States Patent
Khajeh et al.

(10) Patent No.: US 9,597,709 B2
(45) Date of Patent: Mar. 21, 2017

(54) VARIABLE THICKNESS ACOUSTIC TRANSDUCERS

(71) Applicants: Ehsan Khajeh, Spring, TX (US); Roger R. Steinsiek, Houston, TX (US)

(72) Inventors: Ehsan Khajeh, Spring, TX (US); Roger R. Steinsiek, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 413 days.

(21) Appl. No.: 14/225,911

(22) Filed: Mar. 26, 2014

(65) Prior Publication Data

US 2015/0281848 A1 Oct. 1, 2015

(51) Int. Cl.
*B06B 1/06* (2006.01)

(52) U.S. Cl.
CPC ..... *B06B 1/0622* (2013.01); *Y10T 29/42* (2015.01)

(58) Field of Classification Search
CPC ..... B06B 1/0622
USPC ..... 381/190; 367/140
See application file for complete search history.

(56) References Cited

U.S. PATENT DOCUMENTS

2003/0013968 A1 1/2003 Fjield et al.
2003/0173867 A1* 9/2003 Mauchamp ..... B06B 1/0622 310/311
2009/0079301 A1 3/2009 Grohmann et al.
2010/0280420 A1 11/2010 Barthe et al.
2013/0294203 A1 11/2013 Goodman et al.
2013/0342077 A1 12/2013 Lautzenhiser et al.
2015/0183000 A1* 7/2015 Tai ..... G01S 7/52017 367/7

OTHER PUBLICATIONS

Liu et al., "A Single-Element Transducer with Nonuniform Thickness for High-FrequencyBroadband Applications", IEEE Transactions on Ultrasonics, Ferroelectrics, and Frequency Control, vol. 56, No. 2, Feb. 2009, pp. 379-386.
Notification of Transmittal of the International Search Report and the Written Opinion of the International Searching Authority, or the Declaration; PCT/US2015/021474; Mail date Jun. 25, 2015; 13 pages.

* cited by examiner

*Primary Examiner* — Mark Hellner
(74) *Attorney, Agent, or Firm* — Cantor Colburn LLP

(57) ABSTRACT

An embodiment of an acoustic transducer assembly includes: a piezoelectric active element configured to emit acoustic signals, the active element having an emitting surface and a back surface located opposite the emitting surface, at least a portion of the back surface having a shape that forms a curve, the shape configured to cause the active element to have a variable thickness between the emitting surface and the back surface; and a backing material disposed in contact with the backing surface and configured to absorb the acoustic signals, the backing material shaped to conform to the back surface.

20 Claims, 4 Drawing Sheets

VARIABLE THICKNESS ACOUSTIC TRANSDUCERS

BACKGROUND

Acoustic imaging includes a variety of techniques that are used in the energy industry to measure or estimate characteristics of earth formations. For example, ultrasonic imaging tools can be deployed in a borehole and used to obtain information regarding formation characteristics such as lithology and fracture configurations. Such tools can also be used to determine casing conditions. Transducer bandwidth, signal quality, and sensitivity are important criteria for designing acoustic transducers.

SUMMARY

An embodiment of an acoustic transducer assembly includes: a piezoelectric active element configured to emit acoustic signals, the active element having an emitting surface and a back surface located opposite the emitting surface, at least a portion of the back surface having a shape that forms a curve, the shape configured to cause the active element to have a variable thickness between the emitting surface and the back surface; and a backing material disposed in contact with the backing surface and configured to absorb the acoustic signals, the backing material shaped to conform to the back surface.

An embodiment of a method of manufacturing an acoustic transducer assembly includes: forming a piezoelectric active element configured to emit acoustic signals, the active element having an emitting surface and a back surface located opposite the emitting surface, and shaping at least a portion of the back surface to form a curve, the curve configured to cause the active element to have a variable thickness between the emitting surface and the back surface; and disposing a backing material in contact with the backing surface, the backing material configured to absorb the acoustic signals, the backing material shaped to conform to the back surface.

BRIEF DESCRIPTION OF THE DRAWINGS

The following descriptions should not be considered limiting in any way. With reference to the accompanying drawings, like elements are numbered alike.

DETAILED DESCRIPTION

Apparatuses, systems and methods are provided for generating acoustic signals. Embodiments include an acoustic transducer including a variable thickness active element. The variable thickness may be accomplished by forming a back surface of the active element with a selected shape (e.g., circular, elliptical, spherical ellipsoid). In one example, a variable-thickness piezocomposite (or other piezoelectric) transducer is configured to provide a broad-band ultrasonic output for, e.g., downhole measurements. The bandwidth of the transducer can be adjusted by adjusting the thickness range of the active element. Embodiments described here provide superior bandwidth and signal characteristics (e.g., smoothness and sensitivity) relative to other transducers such as fixed thickness piezoelectric transducers.

In one embodiment, the back surface of the active element is curved (e.g., as a concave or convex surface) and the active element is configured to provide the above-mentioned characteristics without focusing the transmitted acoustic signals (i.e., signals transmitted to a region of interest for measurement). For example, the active element has a curved back surface and a flat front surface (i.e., emitting surface). In another embodiment, if beam focusing is desired, the active element may include a flat or curved back surface and a curved (e.g., concave) front surface.

Figure 1:
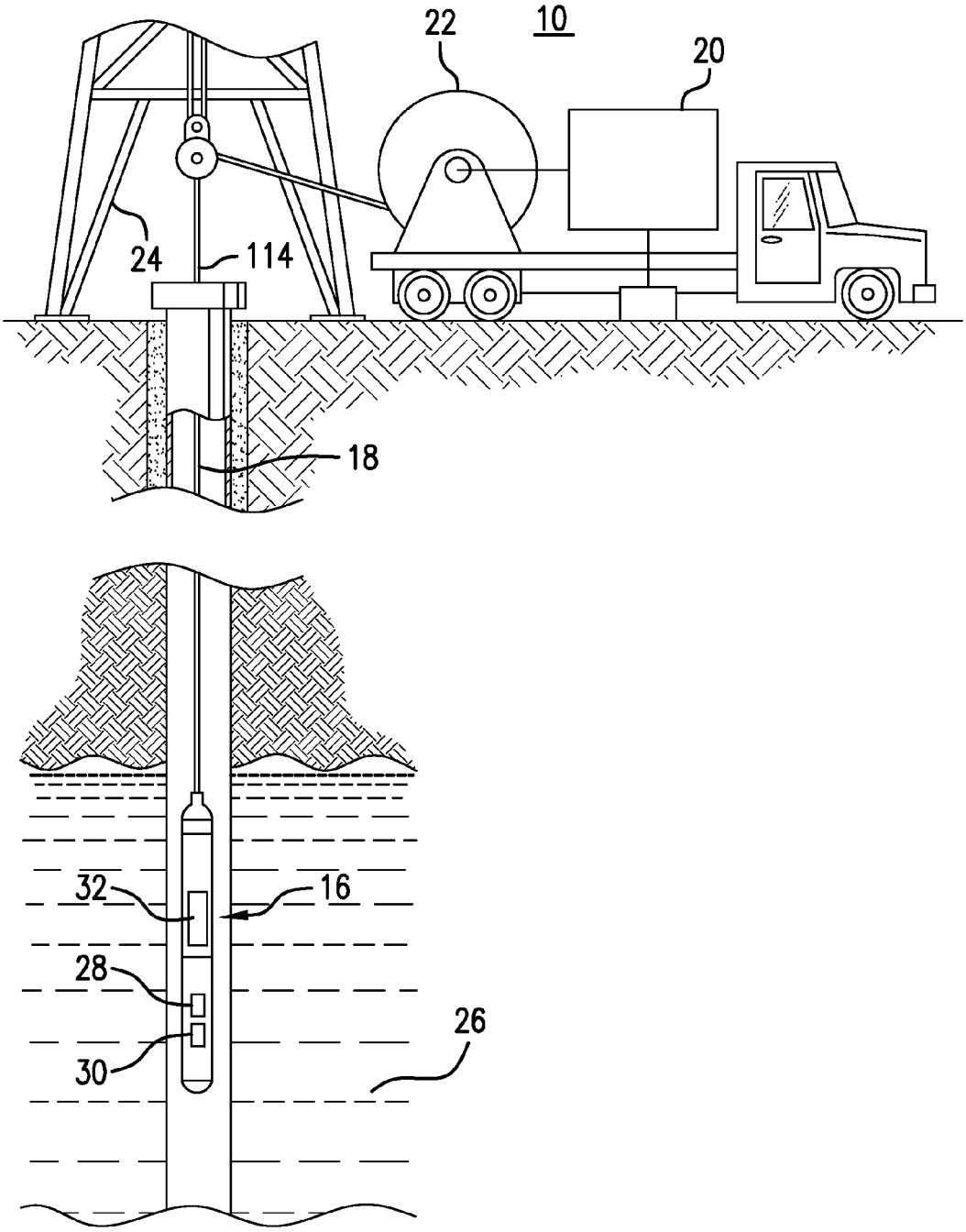
FIG. 1 depicts an embodiment of a system for evaluating or measuring a formation.

FIG. 1 illustrates aspects of an exemplary embodiment of a system 10 for performing energy industry operations such as formation measurement and/or evaluation, hydrocarbon production, completion and stimulation. The system 10 includes a borehole string 12 such as a pipe string, coiled tubing, wireline or other carrier disposed within a borehole 14 that is suitable for lowering a tool or other component through a borehole or connecting a component to the surface. The term "carrier" as used herein means any device, device component, combination of devices, media and/or member that may be used to convey, house, support or otherwise facilitate the use of another device, device component, combination of devices, media and/or member. Exemplary non-limiting carriers include casing pipes, wirelines, wireline sondes, slickline sondes, drop shots, downhole subs, BHA's, frac ports and drill strings.

In the example shown in FIG. 1, the system 10 is configured as a well logging system that includes a logging assembly or tool 16 that is disposed in the borehole 14 via a wireline 18. A Surface deployment system includes a surface control unit 20 for controlling a winch 22 or other deployment device that lowers the wireline 18 from a rig 24, platform, wellhead and/or other surface structure. The system 10 may include various other components for facilitating a measurement operation, and/or for facilitating other energy operations. For example, the system 10 may include a pumping device in fluid communication with a fluid tank or other fluid source for circulating fluid through the borehole 14. The system 10 may also include a drilling assembly. Measurement operations can thus be performed in conjunction with various energy industry operations, such as drilling operations, stimulation operations (e.g., hydraulic fracturing and steam lift), completion operations and production operations.

The tool 16 may be configured as a data acquisition tool that is a part of a measurement and/or monitoring system. The data acquisition tool 16 is disposed in the borehole 14 and advanced to an area or location of interest within a formation 26. The data acquisition tool 16 is configured to emit measurement signals into the formation 26 to estimate characteristics thereof. The borehole 14 may be a vertical borehole as shown in FIG. 1, but is not so limited. The borehole or portions thereof can be vertical, deviated and/or horizontal, and can have any selected path through a formation.

In one embodiment, the tool 16 and/or the system 10 is configured for acoustic imaging of the formation 26 and/or other area of interest. The tool 16 includes one or more acoustic monopole and/or multipole transmitters 28 that emit ultrasonic and/or other acoustic energy pulses (also referred to as "measurement signals" or "acoustic signals"). One or more acoustic receivers 30 are disposed at the tool 16 for receiving acoustic signals from the borehole and/or formation 26. In one embodiment, the tool 16 is configured for ultrasonic imaging of the borehole and/or formation. For example, features of the formation can be evaluated by imaging formation fractures. The casing can be evaluated by imaging the casing after it is in the borehole and before and/or after cementing.

In one embodiment, the data acquisition tool 16 is configured to monitor and/or collect data related to formation characteristics. The tool 16 may be deployed downhole via any suitable carrier and may be configured to operate in conjunction with other downhole or surface tools. In one embodiment, the tool 16 and/or other downhole components are in communication with one or more processing units or devices, such as a downhole electronics unit 32 and/or a surface processor such as the control unit 20. The processing devices are configured to perform various functions including receiving, storing, transmitting and/or processing data from the tool 16. The processing devices include any number of suitable components, such as processors, memory, communication devices and power sources. Communication can be achieved via any suitable configuration, such as acoustic, electrical or optical communication, wireless communication and mud pulse telemetry.

The tool 16 (or other surface or downhole acoustic device) includes an acoustic transducer having an active element configured to be actuated to vibrate and emit acoustic signals. An embodiment of the acoustic transducer includes one or more piezoelectric elements configured to emit acoustic signals in response to electrical signals. Exemplary piezoelectric elements include piezoceramics, piezoelectric polymers and piezocomposite materials. Piezocomposite materials include an array of piezoceramic elements embedded in an epoxy or other polymer material. The transducer may be coupled to an electrical circuit to energize the active element to transmit acoustic signals at a selected frequency.

In one embodiment, the acoustic transducer is a variable thickness transducer, which includes an active element having a variable thickness. The active element may be a piezoelectric element or multiple piezoelectric elements having different thicknesses. As described herein, thickness refers to the distance between an emitting surface at which acoustic signals are emitted, and a back surface opposite the emitting surface. For example, the thickness is the distance between the emitting surface and the backing surface along the direction of acoustic signal propagation from the emitting surface.

In one embodiment, the acoustic transducer includes a piezocomposite active element. For example, the active element is a 1-3 type piezocomposite element that includes an array of parallel oriented piezoceramic rods or bars embedded in a polymer matrix.

The acoustic transducer also includes an acoustic attenuator, referred to as a backing, that is disposed in contact with the active element on the back surface opposite the emitting surface in the direction at which acoustic pressure is to be emitted. The backing material is configured to attenuate acoustic signals propagating away from the desired transmission direction and to reduce reflections from the interface between the active element and backing. The backing is held in contact with the transducer by any suitable mechanism, such as an epoxy or an adhesive.

In one embodiment, the backing is shaped to effect contact with the variable thickness active element. For example, the backing is shaped to contact the back surface having variable length piezoelectric or piezoceramic elements in a piezocomposite.

The variable thickness piezocomposite (or other element) transducer provides a broad-band ultrasonic output, e.g., a bandwidth required for downhole measurements. The bandwidth of the transducer depends on the range of the thickness variation, and can be adjusted by adjusting the range of the thickness. Other components of the transducer, such as a relatively stiff casing, high attenuation backing and matching layers may be included to improve the performance of the transducer.

The bandwidth of a transducer is defined as the frequency range of the output acoustic pressure. A 6 dB bandwidth is the range of frequencies at the amplitude half of the maximum amplitude. Dividing this frequency range by the central frequency of the transducer, the bandwidth can be presented in percentage. Bandwidth has an inverse relation with the pulse length, thus higher bandwidth corresponds to shorter pulse length. In many cases, a short pulse broad-band transducer is required for axial distance measurement; especially when the distance between the transducer and target is small. A short pulse is also desirable for thickness measurement procedures. A broad-band transducer is also used in many applications where the energy should be provided over a wide range of frequencies. The broad-band variable thickness transducer described herein is an effective tool for such procedures and applications.

Transducer bandwidth, signal quality, and sensitivity are important criteria for designing acoustic transducers. The transducers and associated methods described herein provide for the increase of transducer bandwidth. In addition, the transducers and methods increase the sensitivity and signal quality of the output pressure.

Figure 2:
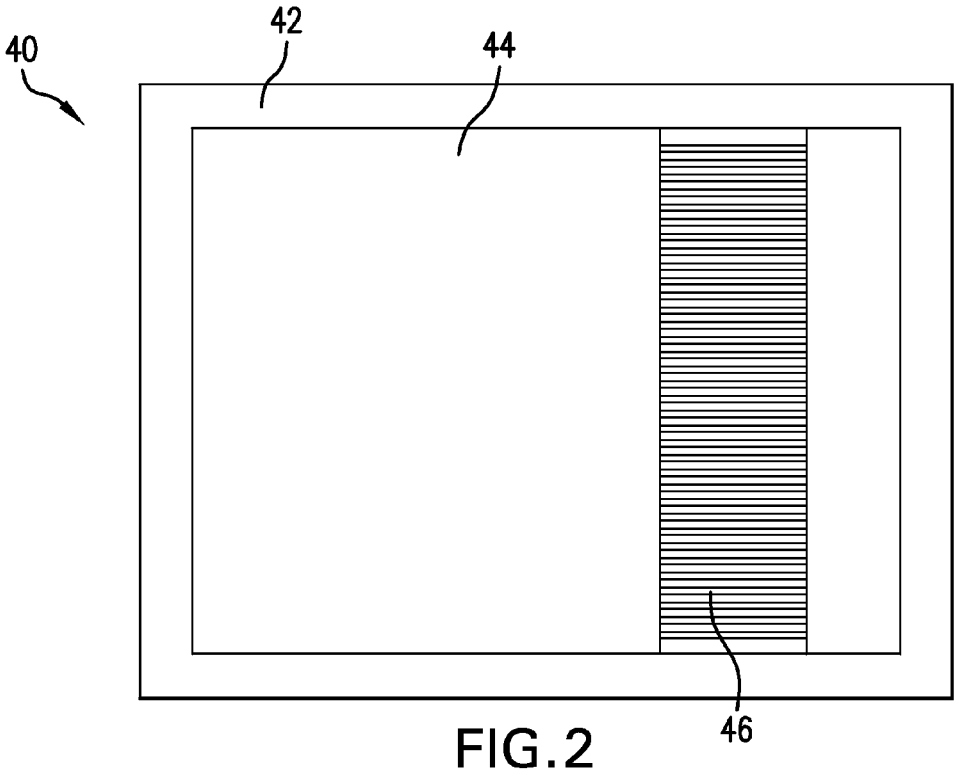
FIG. 2 depicts a cross section of an embodiment of a constant thickness acoustic transducer.
Figure 3:
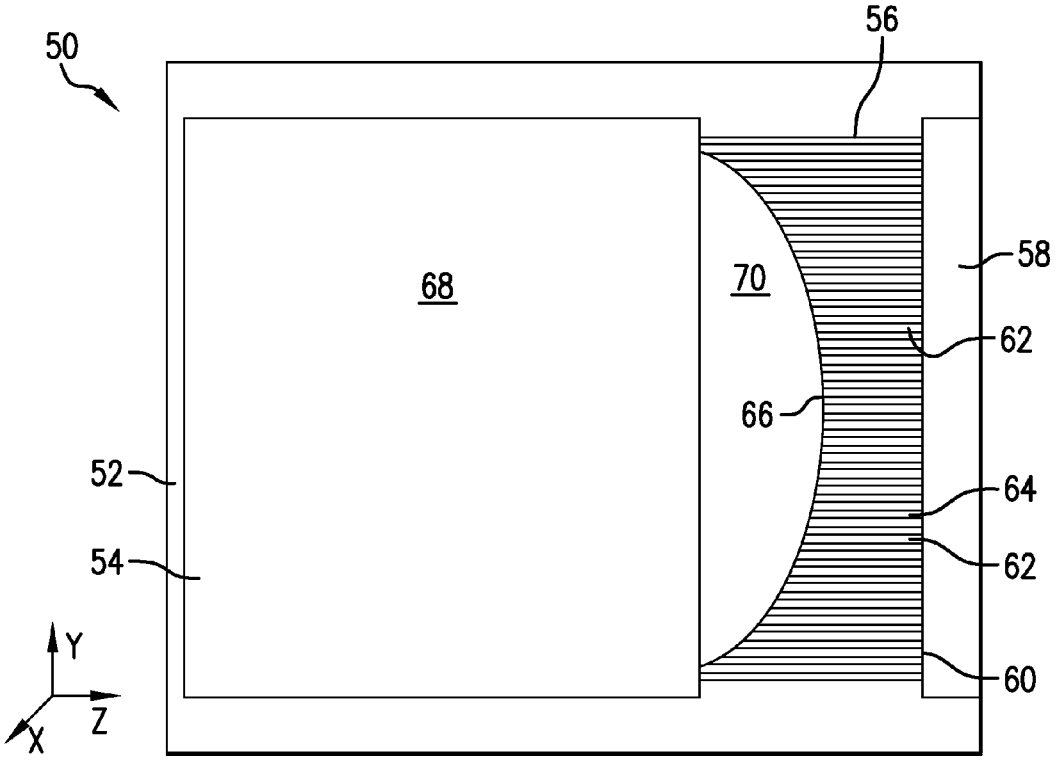
FIG. 3 depicts a cross section of an embodiment of a variable thickness acoustic transducer.

FIGS. 2 and 3 show exemplary piezoelectric transducers. FIG. 2 illustrates a transducer design that includes a constant or fixed thickness active element and backing material. FIG. 3 shows an embodiment of a variable thickness transducer that includes a variable thickness active element and a backing material shaped to contact the active element and conform to the back surface of the active element. In both transducers, the active element includes a 1-3 piezocomposite constructed using piezoceramic bars made from lead zirconate titanate (PZT) within an epoxy matrix. The piezoelectric, piezoceramic and polymer materials that can be used in the transducers are not limited to the specific types described herein.

FIG. 2 shows an acoustic transducer 40 having a fixed-thickness (FT) piezocomposite design. The transducer 40 includes a casing 42 that houses a backing material 44 and a piezocomposite active element 46 that has a fixed thickness. The individual PZT bars in the active element 46 have the same length, which can be optimized to resonate at a specific frequency. The central frequency of the transducer 40 operation is the frequency of the first through-thickness mode of the PZT bars. Such a fixed-thickness transducer, although suitable for narrow band applications, cannot be effectively used for highly broadband applications. In addition, for fixed thickness transducers, the bandwidth is highly dependent on the backing and matching layers.

FIG. 3 shows an embodiment of a variable thickness transducer 50. The variable thickness transducer 50 includes a housing 52, backing material 54 and an active element 56.

The transducer 50 may include a window 58 made of a suitable material through which acoustic signals can be transmitted. An exemplary material is polytetrafluoroethylene, which is sold under the trade name Teflon®, although any material with a desired abrasion resistance and acoustic properties may be utilized. The active element 56 is connected to one or more electrical circuits configured to transmit electric signals causing the active element or elements to vibrate according to selected parameters, e.g., pulse length and frequency. In one embodiment, individual active elements (e.g., piezoelectric bars) or sets of active elements are separately coupled to electrical circuits to allow for adjusting acoustic emission parameters such as beam shape and direction.

In the embodiment of FIG. 3, the active element 56 includes a plurality of piezoelectric elements configured to emit acoustic signals from an emitting surface 60 when actuated. In this example, the active element 56 is a piezo-composite element including a three-dimensional array of piezoceramic bars 62 disposed in an epoxy or other polymer material 64. The array forms the emitting surface 60 as a flat planar emitting surface that extends along a plane (defined by the x-axis and y-axis) perpendicular to the desired direction of propagation (defined by the z-axis) of acoustic signals from the emitting surface 60. In this embodiment, the direction of propagation corresponds to the direction of each the bar lengths.

Although the array is described in this embodiment as including a plurality of individual elements, it is not so limited. Instead of assembling individual elements into an array, a single element can be segmented to create individual actuating elements. For example, a block, disc or cylinder of piezoelectric material can be cut, grooved, diced or otherwise segmented to create the array from one or more of the chosen shapes.

The backing material 54 is disposed proximate to or in contact with a back surface 66 of the active element 56. The back surface 66 (or back wall) is shaped in order to increase the bandwidth of the transducer 50 by creating a variable thickness between the emitting surface 60 and the back surface 66. For example, variable length piezoelectric bars 62 are secured relative to one another (e.g., via polymer material 64) to achieve the desired shape. In other examples, a constant thickness active element is shaped by removing a portion of the active element from the back surface.

The backing material can be made from various materials, material configurations and combinations to provide acoustic impedance at any temperature. The backing material may be configured to provide impedance at temperatures found in downhole environments, such as oil and gas boreholes. Exemplary materials include polymer materials having a high shear wave attenuation, such as polytetrafluoroethylene, silicone rubber, chlorosulfonated polyethylene and/or a combination of one or more other materials.

The back surface of the active element (e.g., back surface 66 of the element 56) can be removed or otherwise formed in different shapes or curvatures. In one embodiment, the shape includes a curve selected to create a variable thickness active element without sharp thickness changes. Sharp changes in the thickness of the active element can cause disintegration of vibration modes. Any suitable shape can be used, such as an elliptical shape removed from the back as shown in FIG. 3 or a circular shape. In three-dimensions, the shape may be, for example, a cylindrical shape having a semi-circular or semi-elliptical cross-section, a spherical shape or an ellipsoidal shape.

As described herein, a "curve" may refer to any deviation from a straight line, which may or may not be a smooth or gradual deviation. The curve results in a back surface that deviates from a plane perpendicular to the direction of propagation of acoustic signals at the emitting surface. The back surface may form any suitable two- or three-dimensional shape that deviates from a flat plane.

Portions of the active element having different thicknesses (e.g., using bars having different lengths) allows for the generation of different segments of the frequency spectrum. For example, longer bars generate low frequency components of a frequency spectrum and shorter bars generate high frequency components. This results in a broad-band transducer having a wider range of frequencies as compared to fixed-thickness transducers.

Having a variable thickness active element (e.g., variable length bars) provides through-thickness modes of vibration in a wide range of frequencies. Therefore, input energy is absorbed by these modes rather than lateral modes. Thus, most of the injected energy will be absorbed by the through-thickness modes and transferred to water, borehole fluid or other media as acoustic pressure. Consequently, unwanted vibrations are controlled so the ring-down decreases and more energy is driven into the media.

In one embodiment, removing the back of the transducer or otherwise shaping the back surface to create the variable thickness, instead of the front surface of the transducer, eliminates the possibility of unwanted focusing. The focusing instead occurs in the back of the transducer, which is desirable for decreasing the reflection from back of the transducer housing.

For example, the back surface is concave (e.g., as shown in FIG. 3) or convex, and the front surface is at least substantially flat, forming a plano-concave or plano-convex shape, which acts to focus signals from the back of the transducer or active element, and avoids focusing the transmitted acoustic beam. This is useful, e.g., when focusing makes downhole measurements sensitive to casing surface characteristics instead of casing thickness and the cement.

The active element surface shapes and configurations are not limited to those described herein, as any suitable shapes or configurations may be utilized. For example, when focusing is desired, the active element has a back surface that is flat or concave, and a front surface that is concave, forming an active element having a shape similar to a plano-concave or biconcave lens. Other examples include an active element having a concave back surface and a convex front surface, or a convex back surface and a concave front surface (concave-convex).

The backing material is correspondingly configured to conform to the shape of the back surface, so that the entirety of the back surface (or desired portion thereof) is in contact with backing material. This can be accomplished, e.g., by shaping the backing material during manufacture, removing a portion of the backing material, or filling an area bounded by the back surface with backing material. In one embodiment, the backing material includes a section of backing material having selected attenuation or absorption properties, and an additional section of backing material formed from a relatively highly attenuative backing material. For example, the transducer 50 includes a first backing material 68 and a second backing material 70 having a higher attenuation formed between the first backing material 68 and the back surface 66.

Figure 4:
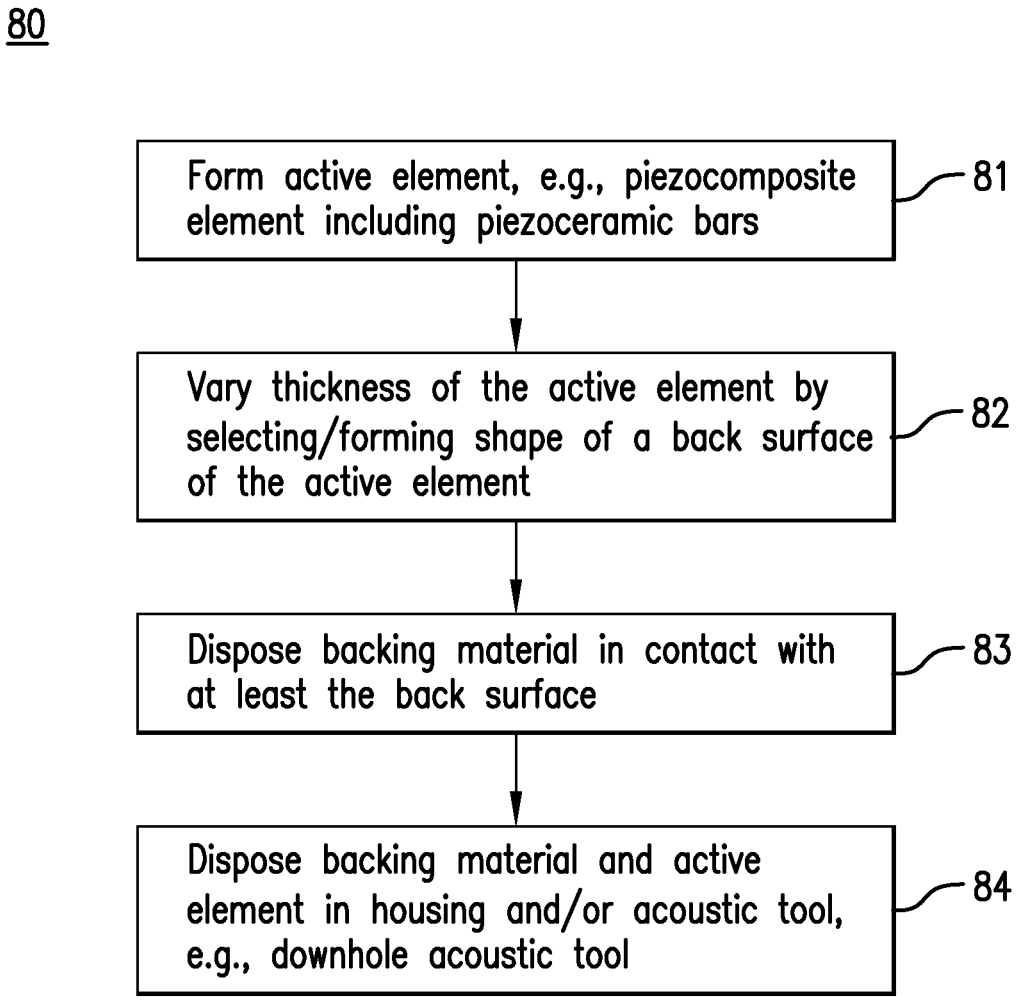
FIG. 4 is a flow chart showing an embodiment of a method of manufacturing a variable thickness acoustic transducer.

FIG. 4 illustrates a method 80 of manufacturing an acoustic transmitter or energy source. The method 80 includes one or more of the following stages 81-84. The method is described herein in conjunction with a processor (e.g., the processing unit 20), but is not so limited, and can be performed in conjunction with any number of processing devices. In one embodiment, stages 81-84 are performed in the order described, although some stages may be performed in a different order or together, or one or more stages may be omitted.

In the first stage 81, an active element is formed, such as a piezoelectric active element. In one embodiment, a plurality of piezoelectric bars or other elements are arranged in an array (e.g., a three dimensional array or circumferential/ring array). For example, a piezocomposite element is formed by positioning an array of elements and filling the spaces therebetween with an epoxy or other polymer.

In the second stage 82, the thickness of the active element is varied to provide broadband capability. In one embodiment, the length of individual bars or elements or the shape of the overall element selected so that the back surface forms a curve or otherwise varies the thickness. The shape can be formed during manufacture or assembly of the active element (e.g., by selecting and positioning different length bars or during formation of the active element), or a portion of the active element can be removed. In one embodiment, the back surface is modified while maintaining the emitting surface as a flat plane or ring to avoid unwanted focusing.

In the third stage 83, a backing material is disposed in contact with at least the back surface of the active element. For example, the backing surface is shaped to conform to a housing shape and conform to an area produced by the variable back surface. The backing material can be formed as a single component or as multiple components. In one example, the backing material is formed by filling a cavity formed by the back surface with fluid material and allowing the material to cure or harden. In one embodiment, an empty volume is produced by removing a portion of the back of the active element and filling the empty volume with highly attenuative backing material.

In the fourth stage 84, the active element and the backing material are disposed in a housing, acoustic transmission and/or measurement device, or other suitable structure. For example, the backing material is shaped and disposed in a hollow cylindrical or other elongated housing. The transducer further can be configured for use in various environments. For example, the transducer can be disposed within a borehole string or acoustic tool for deployment in a borehole. The transducer can be disposed at or in the string, and/or mounted on an extendable arm or member to extend the transducer into the borehole annulus and/or contact the borehole wall.

Figure 5:
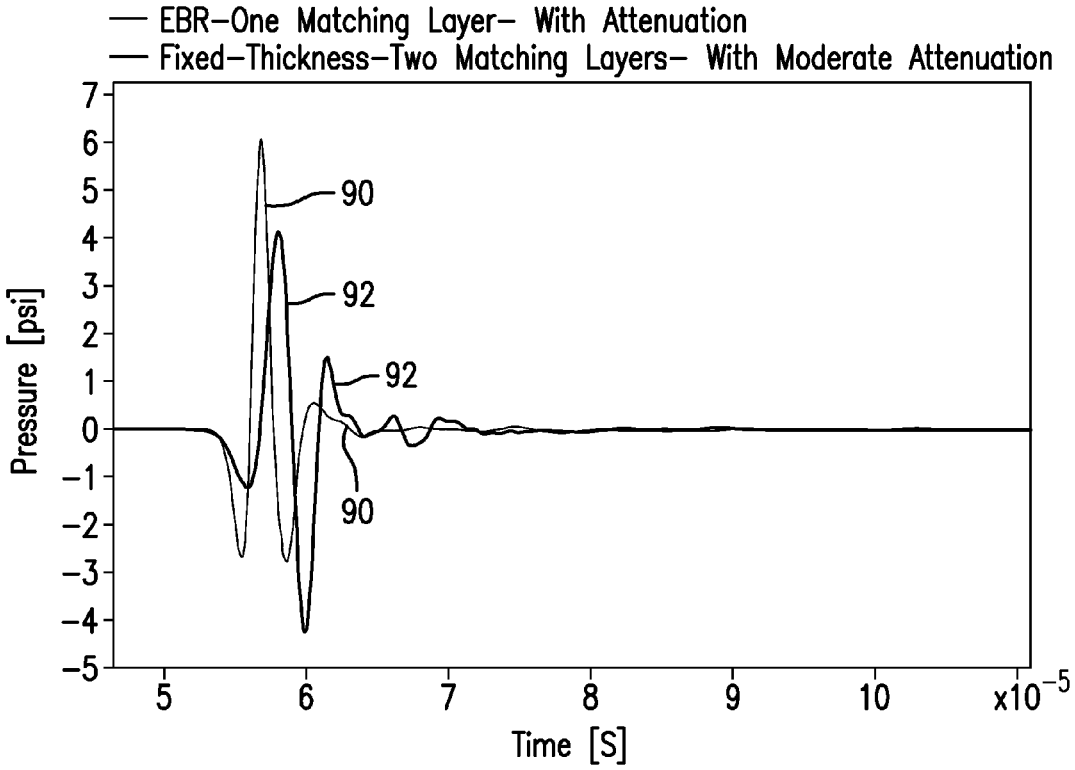
FIG. 5 is a graph showing exemplary acoustic signals from a variable thickness transducer and a constant or fixed thickness transducer.
Figure 6:
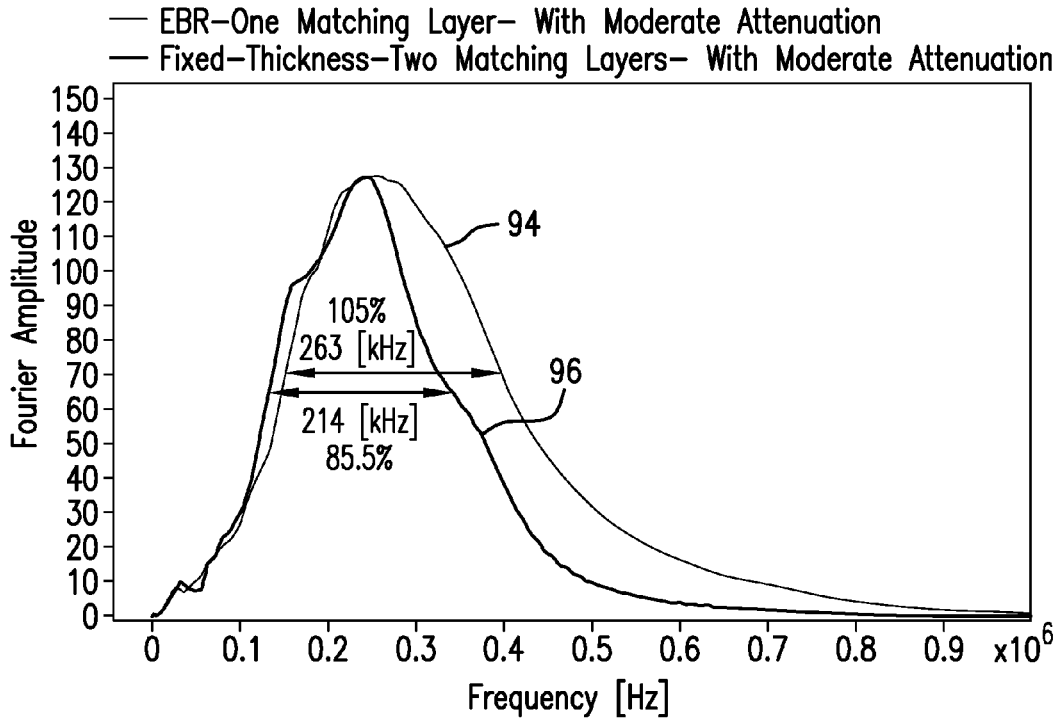
FIG. 6 is a graph showing the frequency spectra of the acoustic signals of FIG. 5.

FIGS. 5 and 6 demonstrate various advantages of the variable thickness transducers described herein and constant thickness transducers. In these examples, a fixed thickness transducer such as the transducer 40 is compared to a variable thickness transducer such as the transducer 50. Also in these examples, the transducers are similar in design, with the only significant difference between the transducers being the shape of the active element, formed by shaping the back surface of the active element.

As is demonstrated below, acoustic signals from the variable thickness transducer exhibit superior quality. Signal quality can be defined in different ways. Here, the signal quality is defined based on the smoothness of the frequency spectrum of the output signal and amplitude and duration of ringing. A signal has high quality when the output frequency spectrum is smooth and ringing is low. Some measurements are based on the location and depth of notches in the frequency spectrum of the reflected wave from a target. Therefore the generated wave by the transducer should be notch free. Most of the notches in frequency spectrum are created by the ringing in the signal.

FIG. 5 shows an output signal 90 from the variable thickness transducer and an output signal 92 from the fixed thickness transducer. As is shown in FIG. 5, the ringing of the variable thickness transducer is significantly lower than the fixed thickness transducer. In addition, the sensitivity of the variable thickness transducer is superior, as shown by the higher amplitude of the signal 90.

FIG. 6 shows the frequency spectrum of the output signals 90 and 92. Curve 94 shows the frequency spectrum of the output signal 90 from the variable thickness transducer, and curve 96 shows the frequency spectrum of the output signal 92 from the fixed thickness transducer. As shown, the variable thickness transducer has a significantly larger bandwidth (about 263 kHz) compared to the fixed thickness transducer (about 214 kHz). In addition, the frequency spectrum of the variable thickness transducer is significantly smoother than the fixed thickness transducer.

The transducer embodiment can be effectively utilized in energy industry operations, such as formation evaluation and other operations (e.g., wireline or LWD). An exemplary method for imaging a borehole and/or formation includes one or more of the following stages. The method is described herein in conjunction with a processor (e.g., the processing unit 20), but is not so limited, and can be performed in conjunction with any number of processing devices. In one embodiment, the stages are performed in the order described, although some steps may be performed in a different order or one or more steps may be omitted.

In a first stage, an imaging tool such as the tool 16 including a variable thickness transducer (e.g., transducer 50) is disposed in a borehole in an earth formation.

In a second stage, when the tool is deployed at or near an area of interest, the transducer is activated to produce an acoustic signal. The signal may be emitted in a single direction or moved. For example, the transducer can be advanced axially through the borehole, rotated during activation and/or electronically steered by varying the timing of element pulses to individual active elements or groups of elements.

In the third stage, one or more acoustic receivers detect the acoustic signal that has been emitted and has propagated through the formation and/or along the borehole. The detected signals are analyzed to estimate characteristics of a borehole, casing or formation. For example, the acoustic image is analyzed to identify fractures and estimate fracture characteristics.

The embodiments described herein provide numerous advantages. For example, various features and embodiments described herein are utilized to improve the performance of an acoustic measurement tool to provide a broad-band ultrasonic output that is greater than other transducers. In addition, unwanted lateral modes are eliminated from the spectrum. The bandwidth can be adjusted, e.g., by varying the range of thickness variation. In addition, features such as stiff housings and/or high attenuation backing and matching layers can be included to improve the performance of the transducer. Furthermore, embodiments described herein increase the sensitivity and signal quality of output acoustic pressure signals.

Generally, some of the teachings herein are reduced to an algorithm that is stored on machine-readable media. The algorithm is implemented by a computer or processor such as the processing unit 20 and/or electronics unit 32 and provides operators with desired output.

In support of the teachings herein, various analysis components may be used, including digital and/or analog systems. The devices, systems and methods described herein may be implemented in software, firmware, hardware or any combination thereof. The devices may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the devices and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure. The computer executable instructions may be included as part of a computer system or provided separately.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An acoustic transducer assembly comprising:

a piezoelectric active element configured to emit acoustic signals, the active element having an emitting surface and a back surface located opposite the emitting surface, at least a portion of the back surface having a shape that forms a curve, the shape configured to cause the active element to have a variable thickness between the emitting surface and the back surface, the active element having a shape configured to focus acoustic signals from the back surface to a backing material; and the backing material disposed in contact with the backing surface and configured to absorb the acoustic signals, the backing material shaped to conform to the back surface.

2. The assembly of claim 1, wherein the active element includes a plurality of elongated piezoelectric elements that extend from the back surface to the emitting surface, wherein at least one elongated piezoelectric element has a different length than at least another elongated piezoelectric element.

3. The assembly of claim 1, wherein the active element includes a piezocomposite material having a plurality of piezoelectric elements disposed in a composite material.

4. The assembly of claim 1, further comprising a housing configured to house the backing material and the active element, the backing material configured to fill a cavity formed by the back surface.

5. The assembly of claim 1, wherein the emitting surface forms a substantially flat surface that is substantially perpendicular to a direction of propagation of acoustic signals from the emitting surface.

6. The assembly of claim 2, wherein the at least one elongated piezoelectric element has a first length configured to emit acoustic signals in a first frequency band, and the at least another elongated piezoelectric element has a second length configured to emit acoustic signals in a second frequency band.

7. The assembly of claim 1, wherein the shape is selected from a circular shape and an elliptical shape.

8. The assembly of claim 1, wherein the backing material includes a first backing material having a first acoustic wave attenuation and a second backing material having a second acoustic wave attenuation that is higher than the first acoustic wave attenuation.

9. The assembly of claim 8, wherein the second backing material is disposed to fill a cavity formed between the first backing material and the back surface.

10. The assembly of claim 1, wherein the emitting surface forms one of a concave surface and a convex surface, and at least a portion of the back surface forms one of a flat surface and a concave surface.

11. The assembly of claim 1, further comprising a housing configured to house the backing material and the active element, the housing configured to be disposed in a borehole in an earth formation.

12. A method of manufacturing an acoustic transducer assembly, the method comprising:

forming a piezoelectric active element configured to emit acoustic signals, the active element having an emitting surface and a back surface located opposite the emitting surface, and shaping at least a portion of the back surface to form a curve, the curve configured to cause the active element to have a variable thickness between the emitting surface and the back surface, the active element having a shape configured to focus acoustic signals from the back surface to a backing material; and disposing the backing material in contact with the backing surface, the backing material configured to absorb the acoustic signals, the backing material shaped to conform to the back surface.

13. The method of claim 12, wherein shaping at least the portion of the back surface includes removing a portion of the active element.

14. The method of claim 12, wherein forming the active element includes disposing a plurality of elongated piezoelectric elements in fixed relation to one another, the elongated piezoelectric elements extending from the back surface to the emitting surface, and shaping includes selecting and positioning piezoelectric elements having different lengths to form the shape.

15. The method of claim 14, wherein the elongated piezoelectric elements are piezoceramic elements disposed in a polymer matrix.

16. The method of claim 12, wherein the emitting surface forms a flat surface that is substantially perpendicular to a direction of propagation of acoustic signals from the emitting surface.

17. The method of claim 14, wherein at least one elongated piezoelectric element has a first length configured to emit acoustic signals in a first frequency band, and at least another elongated piezoelectric element has a second length configured to emit acoustic signals in a second frequency band.

18. The method of claim 12, wherein the backing material includes a first backing material having a first acoustic wave attenuation and a second backing material having a second acoustic wave attenuation that is higher than the first acoustic wave attenuation.

19. The method of claim 18, wherein disposing the backing material includes disposing the first backing material and the active element in a housing, and filling a cavity formed between the first backing material and the back surface with the second backing material.

20. An acoustic transducer assembly comprising:

a piezoelectric active element configured to emit acoustic signals, the active element having an emitting surface and a back surface located opposite the emitting surface, at least a portion of the back surface having a shape that forms a curve, the shape configured to cause the active element to have a variable thickness between the emitting surface and the back surface; and a backing material disposed in contact with the backing surface and configured to absorb the acoustic signals, the backing material shaped to conform to the back surface, wherein the backing material includes a first backing material having a first acoustic wave attenuation and a second backing material having a second acoustic wave attenuation that is higher than the first acoustic wave attenuation.

* * * * *